US006568071B1

(12) United States Patent
Hansel et al.

(10) Patent No.: US 6,568,071 B1
(45) Date of Patent: May 27, 2003

(54) ANGULAR OFFSET METHOD FOR FABRICATING A REGISTRATION GUIDE

(75) Inventors: Gregory A. Hansel, Richfield, MN (US); Bryan L. Hansel, Lakeville, MN (US); Donald C. Hansel, Burnsville, MN (US); Jeffrey J. Johnson, Minneapolis, MN (US)

(73) Assignee: Encoder Science Technologies, LLC, Bloomington, MN (US)

( * ) Notice: Subject to any disclaimer, the term of this patent is extended or adjusted under 35 U.S.C. 154(b) by 0 days.

(21) Appl. No.: 09/504,178

(22) Filed: Feb. 15, 2000

(51) Int. Cl.[7] ..... H01R 43/00

(52) U.S. Cl. ..... 29/825; 29/829; 29/846; 400/112; 400/113

(58) Field of Search ..... 29/825, 846, 881, 29/884, 874, 829, 600; 439/86, 91, 90; 400/112–115; 101/42; 347/229, 234, 248, 116

(56) References Cited

U.S. PATENT DOCUMENTS 4,100,856 A * 7/1978 Ziemba ..... 102/206
4,453,309 A * 6/1984 Shirk ..... 29/884
4,734,788 A * 3/1988 Emmett ..... 358/300
4,746,934 A * 5/1988 Schoening ..... 346/110 R
4,820,913 A * 4/1989 Haddock ..... 235/487
5,909,237 A * 6/1999 Kerr ..... 347/262
6,037,960 A * 3/2000 Kerr ..... 347/172
6,047,733 A * 4/2000 Blake ..... 137/625.16
6,133,936 A * 10/2000 Blake ..... 347/262
6,232,999 B1 * 5/2001 Kerr ..... 347/241

* cited by examiner

*Primary Examiner*—Peter Vo
*Assistant Examiner*—Alan M. Boswell
(74) *Attorney, Agent, or Firm*—Gray, Plant, Mooty, Mooty & Bennett, P.A.

(57) ABSTRACT

A method for fabricating an encoder containing a plurality of registration markings per unit distance for use as a registration reference, for instance for a print head of a printer. The registration markings being aligned in a longitudinal direction. In one preferred method of practicing the invention a polymer substrate on which the encoder is to be imprinted is first provided. An optical imagesetter device is utilized which includes a cylindrical drum and a controllable light source for directing light toward the cylindrical drum. The cylindrical drum includes a surface for receiving the polymer substrate and an axis of rotation. After the polymer substrate is retained upon the drum surface, an image of the encoder is projected upon the retained polymer substrate wherein the longitudinal axis of the encoder being angularly offset relative to the axis of rotation.

14 Claims, 2 Drawing Sheets

ANGULAR OFFSET METHOD FOR FABRICATING A REGISTRATION GUIDE

BACKGROUND OF THE INVENTION

1. Field of the Invention

The present invention relates generally to registration references for the print head of a high resolution laser or ink-jet printer or a plotter, and in particular to method of manufacturing a true-dimension optical encoder strip for a wide-format printer or plotter manufactured using known imagesetting devices.

2. Description of the Prior Art

Printers and plotters utilizing a wide variety of technologies are well known to the art. The term "printers" is used herein generically referring to color and monochromatic (black-and-white) laser printers, inkjet printers, and plotters, unless a particular distinction between these types of devices is specifically called for or noted. In general, many printers and plotters operate using substantially similar or interchangeable technology and components, but are utilized in different applications. Those of skill in the art readily appreciate these distinctions or limitations, and the relative advantages or disadvantages of the corresponding technologies.

Many commercial and personal printers have resolutions of 300 dots per inch (dpi) or greater, with 600 dpi and 1200 dpi becoming standard within recent years. Resolutions of greater than 2000 dpi can be achieved on some high end personal printers, and are conventional for professional printers, typesetting machines, and photoduplicating or photolithography machines.

It is readily appreciated that such printers require great precision and uniformity in the ability to repeatably position the print head. Variations in this precision result in compression or expansion along individual lines of an image, or in elements which lack clarity or definition at the desired dot resolution. Variations between lines will result in abnormally dithered or skewed portions of images, or other irregularities in print quality or clarity. In many graphic images for personal or even professional use, these minor variations will not be readily detectable by normal visual inspection in most applications unless a particular screen pattern or color separation is involved which produces a cascade effect and creates visible distortions throughout larger portions of the total image. By comparison, this lack of precision cannot be tolerated for computer-aided design (CAD) applications. In the case of high resolution or enhanced resolution printers for professional applications, precise print head placement is required to achieve the expected dot resolution of the device over the entire width of the image. Because high resolution images in large formats can be very expensive and slow to produce, plotters are more frequently utilized in applications where a large format image is created (often composed of significant "white space"), but exact accuracy is expected in line weights and the spacing between individual lines, the curvature or length of lines, and the density of image elements.

As such, providing an accurate linear reference to uniformly and repeatably determine the registration or placement of a print head is indispensable for printers and plotters. Many such devices rely on encoder strips which ideally have a multiplicity of discrete markings, equally spaced from one another but without corresponding dimensional references such as inches or points relative to the terminal ends of the encoder strip. A sensor such as an optical emitter/detector is mounted on or near the print head or carriage, and produces a digital or analog signal pulse as the sensor passes and detects each marking. A count of the signal pulses is used to calculate the position of the print head relative to one of the terminal ends of the encoder strip, or to the last reference position of the print head.

However, in practice the uniformity or precision in the spacing and weight of markings on an encoder strip is very much less than ideal. This is due primarily to limitations in the fabrication processes which result in inaccurate registration references. FIGS. 1 and 2 illustrate a prior art encoder strip having an irregular spacing defect or "banding" defect. A distance between adjacent registrations marks 16 varies across the length of the encoder strip. As further discussed herein, the "banding" defect may result from limitations of the imagesetter's control and software systems.

Encoder strips fabricated from a polymer sheet or film such as Mylar® are also known. The markings on these polymer film encoder strips may be imprinted in a variety of ways, however the ultimate accuracy of the encoder strip is limited by the precision of the imprinting process or apparatus. Very high resolutions for imprinting encoder strips can be achieved using a device such as a laser imagesetter designed for electronic tooling, printed circuit board (PCB) fabrication, and wafer photoetching processes. Such imaging systems may be of either planar and drum design. Planar imaging systems, such as disclosed in U.S. Pat. No. 4,841,656, are types of imaging systems which have a planar surface for receiving a substrate. An optical exposure head is located on a movable gantry apparatus and is rastered above the substrate during exposure. Drum imaging systems, which may be of external or internal drum design, have a cylindrical drum surface portion receiving a substrate. A reflected or directed light beam is advanced across the substrate surface during exposure. Examples of such drum imaging systems are disclosed in U.S. Pat. Nos. 5,841,567 and 5,828,501.

A fundamental flaw has existed in the manufacture of encoder strips used for wide format printers. This deficiency is the result of reliance by those of skill in the art on traditional "lines per inch" standards for calculating and controlling image resolution. For example, one inch (1") of encoder strip imprinted for 300 dpi basic (physical) resolution would have an alternating pattern of 150 lines and 150 intervening spaces. However, each line and each space would be one three-hundredths of an inch (1/300") in width. Converting this to decimal form, each line (or space) would have a width of 0.00333333 . . . inches, wherein the row of threes in the decimal would repeat infinitely. For suitable precision, the encoder strip would need to be imprinted using a device that provided accuracy to six decimal places, whereas most available devices default to only four or less decimal places of accuracy. As a result of the inherent limitations of the imagesetter to maintain accuracy across the entire length of the film, variations in the distance between adjacent registrations of the encoder strip results. These variations are often manifested as visual "banding", defects, as illustrated in FIGS. 1 and 2.

The industry has attempted to address this inherent deficiency in several different ways. One method is to use a high resolution imagesetting device to generate a master imprinted on glass (or another permanent material), and using a contact photoprinting process to reproduce encoder strips from that master. This is a relatively slow process, and care must be taken to prevent dust or other contaminants from affecting the contact print. The conventional process of contact printing from a master can lead to loss in image quality, which adversely affects the accuracy or precision of the encoder strip. For wide format encoder strips, the equipment for and corresponding complexity of producing the master can increase the ultimate cost of the encoder strips, and it is necessary to produce a unique master for each version of an encoder strip.

Another method is to imprint markings having only thirty-three thousandths of an inch (0.0033") width and spacing, rounded down from the corresponding infinite decimal. The result is 150 lines and 150 spaces which extend along a total distance of 0.99" for each inch of encoder strip—or 99% of the total length of the encoder strip—for a 1% initial error factor overall. The encoder strip is then mounted by stretching the material to its full 100% length and pinning the opposing ends in place.

Another method is to combine a plurality of individually imprinted strips to form a larger encoder strip. One large encoder strip is thus created from adhesively or otherwise secured plurality of smaller strips. Obviously, the resulting process is inefficient and time consuming.

Another method utilized to correct for the inherent limitation in imprinting resolution is to round the line width and spacing upward rather than downward. Using a sixty-seven thousandths inch (0.0067") combined line width and space rounded up from the corresponding infinite decimal, 150 lines and 150 spaces extend along a total distance of 1.005" for each inch of encoder strip—or 1.005% of the total length of the encoder strip—for a 0.5% initial error factor overall. While this error is less relative to rounding down (assuming a combined spacing of 0.0067" can be achieved while maintaining tolerances), the error must either be incorporated into the printed image or corrected in some manner.

One option is to discard a predetermined number of markings and spaces from one of the terminal ends of the encoder strip. For example, in a 46" wide format, the 0.5% rounding error results in an additional 34.5 lines (45"×150 lines/in.×0.005) lines. Thirty-four lines and an additional space can be discarded from one terminal end of the encoder strip. Another option is to imprint less than all of the full markings, or a partial line or space (or both) per unit of distance. For example, imprinting 149.5 markings per inch by reducing the width of one line and one space by one half reduces the error to 0.17% (per unit distance or total error). The effect is to build a small error into each unit distance (i.e., 0.5 line width per inch). In either case, either the total image width or discrete rows in the image (or both) will be distorted or incorrect, and the ability to perform such an adjustment is dependent on the tolerances and capabilities of the imprinting apparatus.

Another method is disclosed in U.S. Pat. No. 5,941,649, assigned to Encoder Science Technologies, LLC., assignee of the present invention. That method is practiced by producing a template having the desired number of registration indices at reasonably exact tolerances, but at widths and spacing less than or greater than intended for the registration markings, and therefor having an overall length less than or greater than that of the encoder, and using the template to project an image onto a substrate at a suitable scaling factor to form the encoder having the correct widths and spacing of the registration markings on that substrate.

FIGS. 6 and 7 illustrate one prior art technique for efficiently fabricating a plurality of encoder strips upon a single polymer substrate. An imagesetting device having an internal drum for receiving a polymer substrate, is utilized to imprint a plurality of encoder strips upon the substrate. In the past, the longitudinal axis of each encoder strip has been aligned with the axis of rotation of the drum, AR. This results in the edges of the registration marks being a single vertical line segment, as illustrated in FIG. 4. As described above, the control system and software are limited by cumulative and incremental inaccuracies to control the precise. positioning of the vertical line segments of each registration mark of the encoder strips. As further mentioned, the limitation is manifested as a "banding" error, as illustrated FIG. 1.

SUMMARY OF THE INVENTION

The method for fabricating an encoder strip according to this invention produces an encoder strip containing the intended integer number of registration markings (and spaces) per unit distance, over the correct length of that entire encoder strip, so that the registration guide has greater precision, uniformity, and dimensional accuracy. The method overcomes the inherent limitation that an encoder strip composed of lines and spaces disposed in a conventional lines-per-inch (lpi) pattern results in lines and spaces having widths represented as infinite decimals, or finite decimals beyond the available accuracy of equipment used to manufacture those encoder strips.

It is an object of the present invention to provide a method for fabricating a plurality of encoder strips on an optical imagesetting device wherein the edges of each registration mark of each encoder strip are defined by a plurality of disjoint line segments, and not as single line segment as in the prior art. In this regard, the control and software limitations of the imagesetter are removed from the encoder strip by compressing the errors to a non-detectable level. The "banding" error limitation of the imagesetter is still present at a decreased scale, though its effect is not detected by the optical system of a printer device utilizing the improved encoder strip.

Briefly described, the method is practiced by producing an angularly-offset template having the desired number of registration indices at reasonably exact tolerances provided by conventional equipment.

DETAILED DESCRIPTION OF THE PREFERRED EMBODIMENTS

The encoder strip according to this invention and the method of fabricating that encoder are illustrated in FIGS. 3, 5 and 8–9 and referenced generally therein by the numeral 10. The encoder 10 and its method of fabrication or manufacture are illustrated by representative embodiments encompassing a uniform, linear encoder strip 10 having a single or one-dimensional reference axis, RA.

Figure 3:
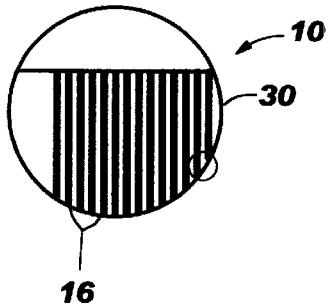
FIG. 3 is a detail view of a portion of an encoder fabricated using the methods of the present invention.
Figure 5:
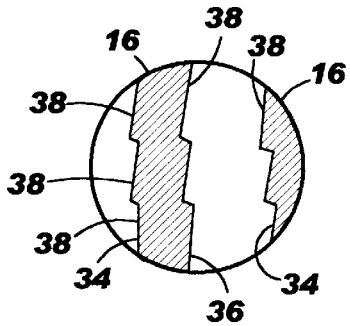
FIG. 5 is a further detailed view of a portion of an encoder strip fabricated using methods of the present invention.

Referring particularly to FIGS. 3 & 5, the illustrative encoder strip 10 is shown comprising a substrate material 12 defining a region 14 containing a multiplicity of markings 16 alternating with an equivalent multiplicity of spaces 18. Each of the markings 16 include a pair of edges 34, 36. The substrate material 12 is preferably a thin polymeric film such as 7 mil (0.0077±0.0005") light sensitive Mylar® film. The substrate 12 is generally clear or transparent apart from the lines 16.

Figure 1:
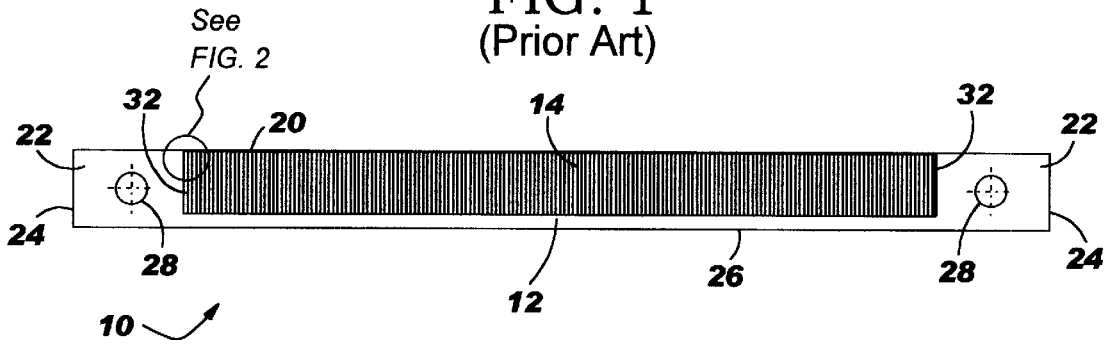
FIG. 1 (Prior Art)
FIG. 1 is a top plan view of an encoder strip embodiment fabricated using methods of the prior art.
Figure 2:
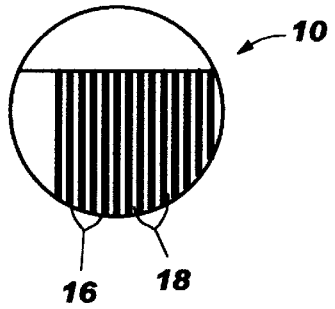
FIG. 2 (Prior Art)
FIG. 2 is a detail view of the portion of the encoder of FIG. 1 shown circled in FIG. 1.
Figure 4:
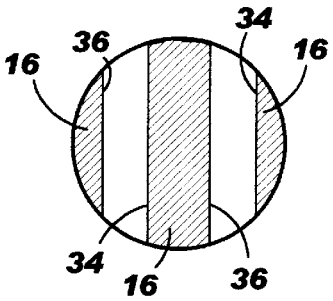
FIG. 4 (Prior Art)
FIG. 4 is a further detailed view of a portion of an encoder strip fabricated using methods of the prior art.

At the level of magnification of FIGS. 2 and 3, the multiplicity of markings 16 are preferably generally parallel with one another and equidistantly spaced along and adjacent one longitudinal edge 20 of the substrate 12, with an open region 22 devoid of markings 16 positioned on each side of the region 14 and disposed proximate to each opposing end edge 24 of the substrate 12. The region 14 of markings 16 preferably traverses only partially across the width of the substrate 12, leaving the opposing longitudinal edge 26 open or devoid of marking 16. FIGS. 2 and 4 illustrate the "banding" or non-uniform spacing defect between adjacent pairs of registration marks 16.

The region 14 of lines 16 preferably traverses only partially across the width of the substrate 12, leaving the opposing longitudinal edge 26 open or devoid of lines 16. It may also be appreciated that only a portion of the region 14 containing the multiplicity of markings or lines 16 may be useable for registration purposes, and that to accommodate existing printer designs the markings or lines 16 may necessarily extend beyond that portion useable for registration or aligned with the printable area.

Registration symbols 28 or markings for properly positioning and aligning the substrate 12 during installation may be imprinted on the substrate 12, those registration symbols being designed or selected as suitable for the particular application, as well as reference indicia such as part number, serial number, fabrication date, revision number, batch or series numbers, surface or orientation identifiers, and so forth. Alternately, the opposing end edges 24 may be cut or trimmed at any orientation or according to any shape at or proximate to the terminal ends 32 of the region 14 of lines 16 and spaces 18.

It may be readily appreciated that the region 14 of lines 16 will appear to an observer without the assistance of visual magnification to be a gray region 14 similar to a halftone, however close inspection will reveal the parallel nature of the lines 16 as opposed to a random, dithered, or stochastic screen pattern associated with a conventional halftone image. The relative degree of shading of the region 14 between transparent (0%) and black (100%) will depend upon the particular width and spacing of the lines 16.

Referring particularly to FIG. 5, a higher magnification of a portion of the encoder strip 10 of FIG. 3, reveals that the edges 34, 36 of the individual registration markings 16 are non-linear, and are instead formed as disjoint step portions 38. The edges 34, 36 of the registration markings 16 are thus defined by a plurality of linear segments 38, as compared to the edges 34, 36 of the prior art registration markings of FIG. 4, which are defined as single linear (vertical) segments. A uniform (average) distance between adjacent edges 34, 36 of registration markings 16 is detected by the optical detector of the printer device utilizing an encoder strip 10 of the present invention. The "banding" defect, which is compressed to a smaller scale, is illustrated in FIG. 5 as variations in the distance between the disjoint edge portions 38 of adjacent edges 34, 36.

Referring now to FIGS. 6–9, the method of fabricating the encoder strip 10 is provided. These processes are intended only as illustrative examples which may be readily practiced by those of ordinary skill in the art in light of the teachings contained in this specification, and are in no event intended to limit or constrain the available processes that may be utilized in practicing the invention as described and claimed herein.

Figure 6:
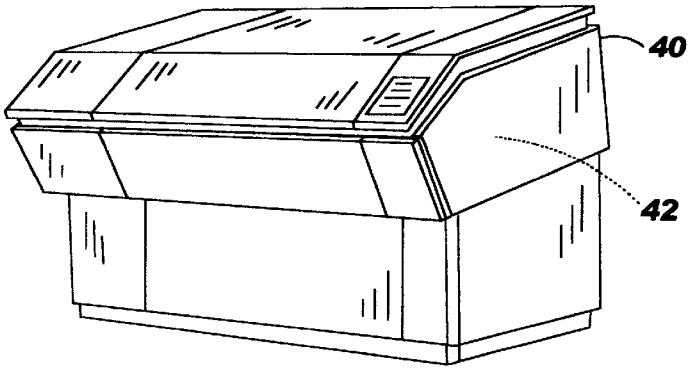
FIG. 6 (Prior Art)
FIG. 6 is a schematic perspective view of an imagesetter device used in the fabrication of the encoder strips of the present invention.
Figure 7:
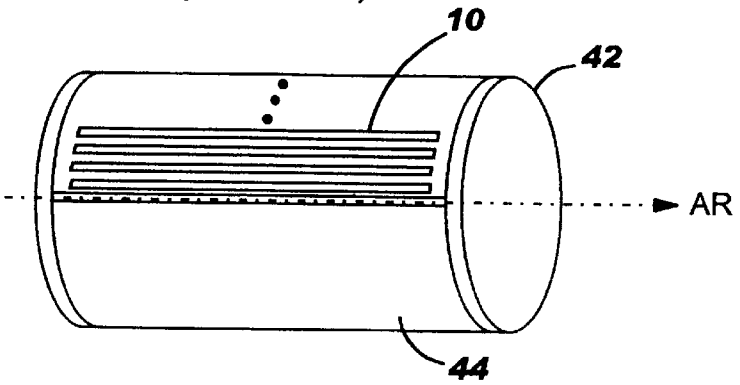
FIG. 7 (Prior Art)
FIG. 7 is a perspective view of a removed external drum from the device of FIG. 6 using the prior art methods of fabrication.

FIG. 6 illustrates an external drum imagesetting device 40 for use in practicing the present invention. One such device is the GigaSetter™ manufactured by Barco Graphics. The GigaSetter™ provides high resolution, repeatability and accuracy to generate output on film in formats up to 96.5× 63.5 inches. A resolution of 5080 ppi is attainable with the 300Q optics package. One component of the imagesetter is the raster image processor (RIP), which accepts the production file and carries out the calculations to meet the specifications of the image. The GigaSetter™ utilizes a proprietary large data volume RIP device.

The external drum imagesetting device 40 has a cylindrical drum 42 with a surface adapted to receive a substrate 44. The substrate 44 may be a polymer, such as polyester, having a photosensitive emulsion coating on one surface thereof or a sheet of photosensitive film. The drum surface further includes a plurality of holes in fluid communication with a plurality of internal channels through which a conventional vacuum source generates a vacuum to hold the substrate in place during an exposure process. Alternative methods can be equivalently used to hold the substrate in place, including electrostatic and mechanical retention techniques.

The imaging system 40 also includes a light reflection or direction device for directing an optical beam onto the substrate surface in response to beam command signals from a controller. A HeNe laser (632.8 nm) is utilized with the GigaSetter™ and is controlled to provide image accuracy and repeatability of +/−0.2 mil (0.005 mm).

Figure 9:
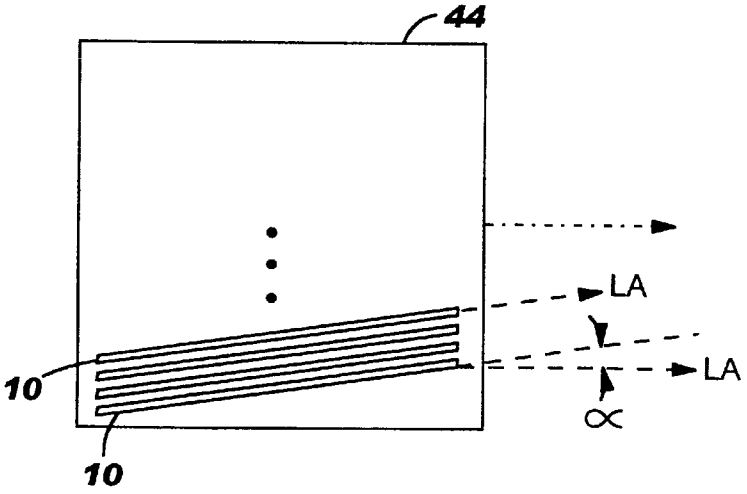
FIG. 9 is a top plan view of a plurality of encoder strips imprinted upon a single substrate using methods of the present invention.
Figure 8:
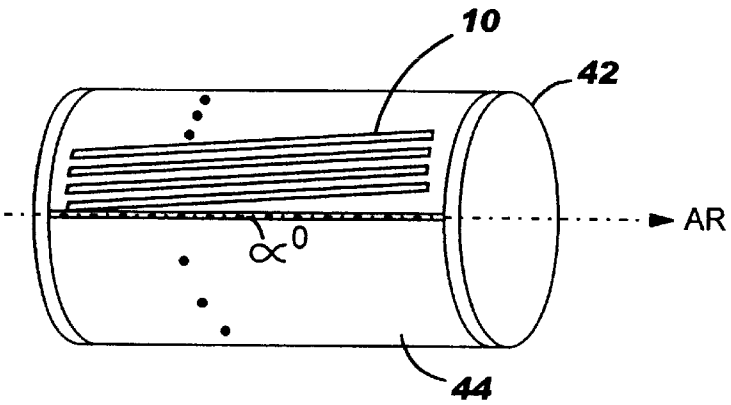
FIG. 8 is a perspective view of a removed external drum from the device of FIG. 6 using the methods of fabrication of the present invention.

Referring now to FIGS. 8 and 9, a portion of the imaging system is illustrated. The substrate 44 is shown retained onto the external drum 42 of the imaging system after an exposure process to fabricate the plurality of encoder strips 10. The encoder strips 10 may not be visible prior to a development process. The external drum 42 includes an axis of rotation, AR. Each encoder strip 10 is longitudinally aligned with an angular offset, ↦, relative to the drum 42 axis of rotation, AR. The angular offset, ↦, of the registrations markings 16 is preferably chosen between approximately 0.1 and 10 degrees. Values for ↦may range from 0.1 to 45 degrees. The RIP system and associated light control system of the imagesetter 40 operatively control the amount of angular offset of each encoder strip 10 relative to the drum 42 axis, AR. FIG. 9 illustrates a developed substrate defining a plurality of encoder strips 10, each aligned with an angular offset, ↦, relative to the longitudinal axis, LA. The plurality of encoder strips 10 may be separated from one another through known slitting or dye cutting techniques.

The representative embodiments described in this specification have utilized a light-sensitive substrate and an image produced by angularly offsetting the encoder strip patterns as described. However, it is understood that the angular offset process may also be utilized with other technologies beyond light-sensitive films or substrates or printing processes. It is contemplated that angular offsetting of encoder strips may be accomplished through a variety of other modalities beyond exposure- or printing-based systems, including other optical, mechanical, electrical, and chemical techniques or computer-performed algorithms.

While the preferred embodiments of the above encoder strip 10 and its method of fabrication or manufacture 10 have been described in detail with reference to the attached drawings, it is understood that various changes, modifications, and adaptations may be made in the encoder strip 10 or method 10 without departing from the spirit and scope of the appended claims.

What is claimed is:

1. A method for fabricating a plurality of encoders on a sheet of polymer substrate, each of said plurality of encoders for use as a registration reference for a print head of a printer, each of said plurality of encoders having a plurality of registration markings aligned in a longitudinal direction, said method comprising the steps of:

providing an optical imagesetter device having a curved surface rotatable about an axis of rotation for receiving the substrate and a controllable light source for directing light onto the substrate, said curved surface having an axis of curvature;

providing the substrate onto the curved surfaced on which the plurality of encoders are to be imprinted; and aligned and projecting an image of the plurality of encoders onto the substrate with the longitudinal axes of the plurality of encoders being substantially parallel, the longitudinal axis of each of the plurality of encoders being offset relative to the axis of rotation by a predetermined angle that is inclusive of 0.1 degree to 45 degrees.

2. The method of claim 1 wherein the curved surface is defined upon either a cylindrical drum or an internal drum.

3. The method of claim 1 wherein the predetermined angle is selected from between 0.1 and 10 degrees.

4. The method of claim 1 wherein the predetermined angle is approximately 1 degree.

5. The method of claim 1 further comprising the step of:

slicing the substrate to form the plurality of encoders.

6. The method of claim 1 wherein the plurality of registration marking are generally spaced apart opaque segments alternating with generally transparent spaces.

7. A method for fabricating a plurality of encoders, each of said plurality of encoders for use as a registration reference for a print head of a printer, each of said plurality of encoders having a plurality of registration markings aligned in a longitudinal direction, said method comprising the steps of:

providing a polymer substrate on which the plurality of encoders are to be imprinted;

providing an optical imagesetter device having cylindrical drum and a controllable light source for directing light toward said cylindrical drum, said cylindrical drum having an axis of rotation and a surface for receiving the polymer substrate;

providing the polymer substrate onto the drum surface; and aligning and projecting an image of the plurality of encoders onto the polymer substrate so that the longitudinal axis of the plurality of encoders are substantially parallel, the longitudinal axis of the plurality of encoders being offset relative to the axis of rotation by a predetermined angle that is inclusive of 0.1 degree to 45 degrees.

8. The method of claim 7 wherein the predetermined angle is selected from between 0.1 and 10 degrees.

9. The method of claim 7 wherein the predetermined angle is approximately 1 degree.

10. The method of claim 7 further comprising the step of:

slicing the substrate to form the plurality of encoders.

11. A method for fabricating an encoder for use as a registration reference for a print head of a printer, said encoder having a plurality of registration markings aligned in a longitudinal direction, said method comprising the steps of:

providing a polymer substrate on which the encoder is to be imprinted;

providing an optical imagesetter device having a cylindrical drum and a controllable light source for directing light toward said cylindrical drum, said cylindrical drum having a surface for receiving the polymer substrate and an axis of rotation;

retaining the polymer substrate onto the drum surface; and aligning and projecting an image of the encoder onto the retained polymer substrate, the longitudinal axis of the encoder being angularly offset relative to the axis of rotation by an angular offset of 0.1 degree to 45 degrees.

12. The method of claim 11 wherein the angular offset is selected from between 0.1 and 10 degrees.

13. The method of claim 11 wherein the angular offset is approximately 1 degree.

14. The method of claim 1 wherein the plurality of registration marking are generally spaced apart opaque segments alternating with generally transparent spaces.

* * * * *